US009047817B2

(12) United States Patent
Hwang

(10) Patent No.: US 9,047,817 B2
(45) Date of Patent: Jun. 2, 2015

(54) ORGANIC LIGHT EMITTING DISPLAY DEVICE

(75) Inventor: Young-In Hwang, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 494 days.

(21) Appl. No.: 12/969,539

(22) Filed: Dec. 15, 2010

(65) Prior Publication Data

US 2011/0292014 A1 Dec. 1, 2011

(30) Foreign Application Priority Data

Jun. 1, 2010 (KR) ..... 10-2010-0051681

(51) Int. Cl.
*G09G 3/32* (2006.01)
*G09G 5/00* (2006.01)

(52) U.S. Cl.
CPC ..... *G09G 3/3233* (2013.01); *G09G 2300/0819* (2013.01); *G09G 2300/0842* (2013.01); *G09G 2300/0861* (2013.01); *G09G 2300/0866* (2013.01); *G09G 2310/0262* (2013.01)

(58) Field of Classification Search
CPC ..... G09G 3/3233; G09G 2310/0262; G09G 2300/0861; G09G 2300/0866; G09G 2300/0819; G09G 2300/0842
USPC ..... 345/76–83, 204, 690, 211; 315/169.3
See application file for complete search history.

(56) References Cited

U.S. PATENT DOCUMENTS

2004/0095338 A1* 5/2004 Miyazawa ..... 345/204
2004/0251846 A1 12/2004 Choi et al.
2005/0017934 A1* 1/2005 Chung et al. ..... 345/82
2006/0261864 A1* 11/2006 Miyazawa ..... 327/112
2008/0024418 A1* 1/2008 Kim ..... 345/98
2010/0271363 A1* 10/2010 Chung ..... 345/213

FOREIGN PATENT DOCUMENTS

KR 10-2004-0107047 12/2004
KR 10-2006-0113334 A 11/2006
KR 10-2006-0135749 A 12/2006
KR 10-0893481 B1 4/2009
KR 10-2009-0112199 10/2009
KR 10-2010-0009807 1/2010

OTHER PUBLICATIONS

KIPO Office Action dated May 24, 2012 for Korean priority Patent Application No. 10-2010-0051681, 1 page.

* cited by examiner

*Primary Examiner* — Stephen Sherman
(74) *Attorney, Agent, or Firm* — Christie, Parker & Hale, LLP

(57) ABSTRACT

An organic light emitting display device that can display an image with desired luminance is disclosed. The organic light emitting display device includes: pixels at crossing regions of scan lines and data lines; first control transistors between a first power supply (for supplying current to the pixels) and the pixels in the odd-numbered rows (or, in a second embodiment, the even-numbered rows); and second control transistors between the first power supply and the pixels in the even-numbered rows (or, in the second embodiment, the odd-numbered rows). The first control transistors are configured to turn on and off in alternation with the second control transistors during a scan period of one frame period.

20 Claims, 7 Drawing Sheets

ORGANIC LIGHT EMITTING DISPLAY DEVICE

CROSS-REFERENCE TO RELATED APPLICATIONS

This application claims priority to and the benefit of Korean Patent Application No. 10-2010-0051681, filed on Jun. 1, 2010, in the Korean Intellectual Property Office, the entire content of which is incorporated herein by reference.

BACKGROUND

1. Field

Aspects of embodiments according to the present invention relate to an organic light emitting display device, particularly an organic light emitting display device that can display an image with desired luminance.

2. Description of Related Art

Recently, a variety of flat panel displays have been developed with reduced weight and volume when compared to that of cathode electrode ray tube displays. Typical flat panel displays include liquid crystal displays, field emission displays, plasma display panels, and organic light emitting display devices.

Among these, the organic light emitting display device displays an image using organic light emitting diodes (OLEDs) that produce light through recombination of electrons and holes. Compared to other flat panel displays, the organic light emitting display device has a high response speed and low power consumption. Organic light emitting display devices, however, can display images with nonuniform brightness due to such factors as inconsistent threshold voltages of the driving transistors of the different OLEDs, and deterioration of the OLEDs over time.

SUMMARY

Aspects of embodiments of the present invention are directed to providing an organic light emitting display device that can display an image with desired luminance.

In an exemplary embodiment of the present invention, an organic light emitting display device is disclosed. The organic light emitting display device includes pixels, first control transistors, and second control transistors. The pixels are at crossing regions of scan lines and data lines. The scan lines extend along a horizontal direction. The pixels are arranged in rows extending along the horizontal direction. The pixels include first pixels and second pixels. The first pixels include one of pixels in odd-numbered rows or pixels in even-numbered rows. The second pixels include an other of the pixels in the odd-numbered rows or the pixels in the even-numbered rows. The first control transistors are between a first power supply and the first pixels. The first power supply is for supplying current to the pixels. The second control transistors are between the first power supply and the second pixels. The first control transistors are configured to turn on and off in alternation with the second control transistors during a scan period of one frame period.

The organic light emitting display device may further include a scan driving unit, a data driving unit, and a control signal generating unit. The scan driving unit is for sequentially supplying a scan signal to the scan lines during the scan period. The data driving unit is for supplying data signals to the data lines during the scan period. The control signal generating unit is for supplying first control signals to the first control transistors and second control signals to the second control transistors during the scan period.

The scan driving unit may be configured to supply the scan signal to an i-th scan line (i is a natural number) of the scan lines to overlap the scan signal supplied to an (i−1)-th scan line of the scan lines during an overlap period.

The scan driving unit may be further configured to supply the scan signal during a period of width 2H. The overlap period may have a width 1H.

The control signal generating unit may be further for supplying the first and second control signals such that the first control transistors are configured to turn on and off in alternation with the second control transistors during a period when the scan signal is supplied to one of the scan lines.

The one frame period may include the scan period and an emission period. The control signal generating unit may further be for supplying the first and second control signals such that the first and second control transistors are configured to turn on during the emission period.

Each of the pixels in an i-th row (i is a natural number) of the rows may include an organic light emitting diode (OLED), first through third transistors, and a storage capacitor. The OLED includes a cathode electrode coupled to a second power supply. The first transistor includes a second electrode coupled to the OLED. The first transistor is for controlling an amount of current flowing to the OLED. The second transistor is coupled between the second electrode of the first transistor and one of the data lines. The second transistor is for turning on when the scan signal is supplied to an i-th scan line of the scan lines. The third transistor is coupled between a first electrode of the first transistor and a gate electrode of the first transistor. The third transistor is for turning on when the scan signal is supplied to the (i−1)-th scan line. The storage capacitor is coupled between the gate electrode of the first transistor and the first power supply.

The first electrode of the first transistor may be coupled to one of the first control transistors or one of the second control transistors.

The first, second, and third transistors may include NMOS transistors.

The organic light emitting display device may further include a second power generating unit. The second power generating unit is for supplying high-level voltage to the second power supply during the scan period, and for supplying low-level voltage to the second power supply during an emission period. The one frame period may include the scan period and the emission period.

In another exemplary embodiment of the present invention, an organic light emitting display device is disclosed. One frame period is divided into an initializing period, a scan period, and an emission period. The organic light emitting display device includes pixels, a scan driving unit, a data driving unit, a control line driving unit, and a second power generating unit. The pixels are at crossing regions of scan lines and data lines. The scan driving unit is for sequentially supplying a scan signal to the scan lines during the scan period. The data driving unit is for supplying data signals to the data lines. The control line driving unit is for supplying a first control signal to a first control line coupled to the pixels during the initializing period and the emission period. The second power generating unit is for supplying high-level voltage to a second power supply such that the pixels do not emit light during the initializing period and the scan period, and for supplying low-level voltage to the second power supply during the emission period.

Each of the pixels in an i-th row (i is a natural number) of the pixels may include an organic light emitting diode (OLED), first through fourth transistors, and a storage capacitor. The OLED includes a cathode electrode coupled to the second power supply. The first transistor includes a second electrode coupled to the OLED. The first transistor is for controlling an amount of current flowing to the OLED. The second transistor is coupled between the second electrode of the first transistor and one of the data lines. The second transistor is for turning on when the scan signal is supplied to an i-th scan line of the scan lines. The third transistor is coupled between a first electrode of the first transistor and a gate electrode of the first transistor. The third transistor is for turning on when the scan signal is supplied to the i-th scan line. The fourth transistor is coupled between the first electrode of the first transistor and a first power supply. The fourth transistor is for turning on when the first control signal is supplied to the first control line. The storage capacitor is coupled between the gate electrode of the first transistor and the first power supply.

The scan driving unit may further be for concurrently supplying the scan signal to the scan lines during the initializing period.

The first, second, third, and fourth transistors may comprise NMOS transistors.

The organic light emitting display device may further include second control lines corresponding to the scan lines.

The scan driving unit may be configured to concurrently supply a second control signal to the second control lines during the initializing period, and to sequentially supply the second control signal to the second control lines during the scan period.

The second control signal supplied during the scan period may have a width larger than that of the scan signal.

The scan driving unit may be further configured to supply the scan signal to an i-th scan line (i is a natural number) of the scan lines concurrently with supplying the second control signal to an i-th second control line of the second control lines.

Each of the pixels in an i-th row (i is a natural number) of the pixels may include an organic light emitting diode (OLED), first through fourth transistors, and a storage capacitor. The OLED includes a cathode electrode coupled to the second power supply. The first transistor includes a second electrode coupled to the OLED. The first transistor is for controlling an amount of current flowing to the OLED. The second transistor is coupled between the second electrode of the first transistor and one of the data lines. The second transistor is for turning on when the scan signal is supplied to an i-th scan line of the scan lines. The third transistor is coupled between a first electrode of the first transistor and a gate electrode of the first transistor. The third transistor is for turning on when the second control signal is supplied to an i-th second control line of the second control lines. The fourth transistor is coupled between the first electrode of the first transistor and a first power supply. The fourth transistor is for turning on when the first control signal is supplied to the first control line. The storage capacitor is coupled between the gate electrode of the first transistor and the first power supply.

The first, second, third, and fourth transistors may include NMOS transistors.

According to embodiments of the present invention, an organic light emitting display device can display an image with desired luminance, regardless of the threshold voltage of the driving transistor. Further, the storage capacitor according to embodiments of the present invention is capable of being charged to a desired voltage, regardless of deterioration of the OLED.

BRIEF DESCRIPTION OF THE DRAWINGS

The accompanying drawings, together with the specification, illustrate exemplary embodiments of the present invention, and, together with the description, serve to explain principles of the present invention.

DETAILED DESCRIPTION

Figure 1:
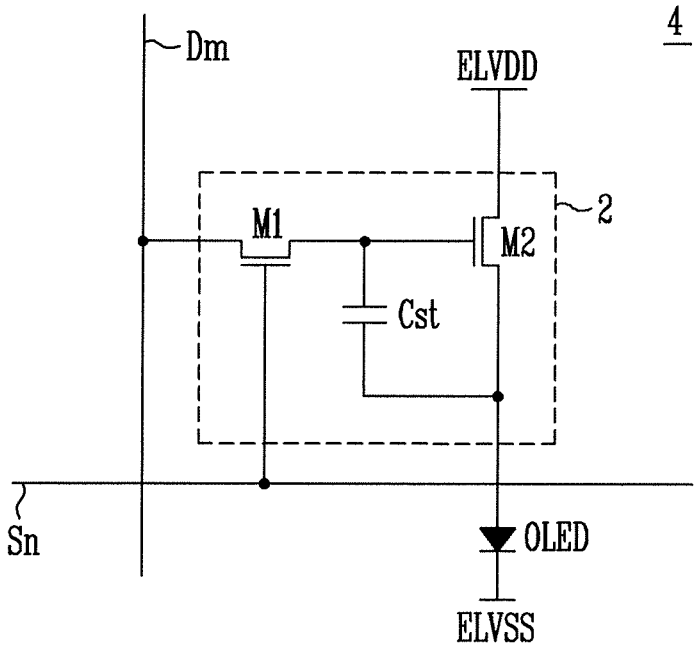
FIG. 1 is a diagram illustrating a pixel of a comparable organic light emitting display device.

Hereinafter, certain exemplary embodiments according to the present invention will be described with reference to the accompanying drawings. Here, when a first element is described as being coupled to a second element, the first element may be directly coupled (e.g., connected) to the second element or indirectly coupled (e.g., electrically connected) to the second element via one or more third elements. Further, some of the elements that are not essential to the complete understanding of the embodiments of the invention are omitted for clarity. In addition, like reference numerals refer to like elements throughout.

Exemplary embodiments of the present invention are described hereafter in detail with reference to FIGS. 2 to 9. A comparable device is illustrated in FIG. 1.

FIG. 1 is a circuit diagram illustrating a pixel 4 of a comparable organic light emitting display device. The transistors included in the pixel 4 of FIG. 1 are NMOS.

Referring to FIG. 1, the pixel 4 includes: an OLED; and a pixel circuit 2 connected with a data line Dm and a scan line Sn, the pixel circuit 2 for controlling the OLED. An anode electrode of the OLED is connected to the pixel circuit 2, and a cathode electrode of the OLED is connected to a second power supply ELVSS. The OLED produces light with set or predetermined luminance in response to a current supplied from the pixel circuit 2.

The pixel circuit 2 controls the amount of current supplied to the OLED in response to a data signal supplied to the data line Dm when a scan signal is supplied to the scan line Sn. For the configuration of FIG. 1, the pixel circuit 2 includes: a second transistor (i.e., a driving transistor) M2 connected between a first power supply ELVDD and the OLED; a first transistor M1 connected between the second transistor M2, the data line Dm, and the scan line Sn; and a storage capacitor Cst connected between a gate electrode of the second transistor M2 and a second electrode of the second transistor M2.

A gate electrode of the first transistor M1 is connected to the scan line Sn, and a first electrode of the first transistor M1 is connected to the data line Dm. Further, a second electrode of the first transistor M1 is connected to one terminal of the storage capacitor Cst. In this configuration, the first electrode is one of a source electrode or a drain electrode, and the second electrode is the other electrode. For example, when the first electrode is the drain electrode, the second electrode is the source electrode. When the scan signal is supplied to the scan line Sn, the first transistor M1 is turned on and supplies the data signal, which is supplied through the data line Dm, to the storage capacitor Cst. In this operation, the storage capacitor Cst is charged to a voltage corresponding to the data signal.

A gate electrode of the second transistor M2 is connected to the one terminal of the storage capacitor Cst, and a first electrode of the second transistor M2 is connected to the first power supply ELVDD. Further, the second electrode of the second transistor M2 is connected to the other terminal of the storage capacitor Cst and the anode electrode of the OLED. The second transistor M2 controls the amount of current flowing from the first power supply ELVDD to the second power supply ELVSS through the OLED, in response to the voltage level stored in the storage capacitor Cst.

One terminal of the storage capacitor is connected to the gate electrode of the second transistor M2, and the other terminal is connected to the anode electrode of the OLED. The storage capacitor Cst is charged to a voltage corresponding to the data signal.

The comparable pixel 4 having the above configuration displays an image with desired luminance by supplying current corresponding to the voltage of the charged storage capacitor Cst to the OLED. However, the comparable organic light emitting display device having the above configuration may have a problem in that it cannot display an image with uniform luminance, due to a difference of the threshold voltage of the second transistor M2 between different pixels. Further, there is a problem in that the voltage stored in the storage capacitor Cst may change with deterioration of the OLED, because the other terminal of the storage capacitor is connected to the anode electrode of the OLED.

Figure 2:
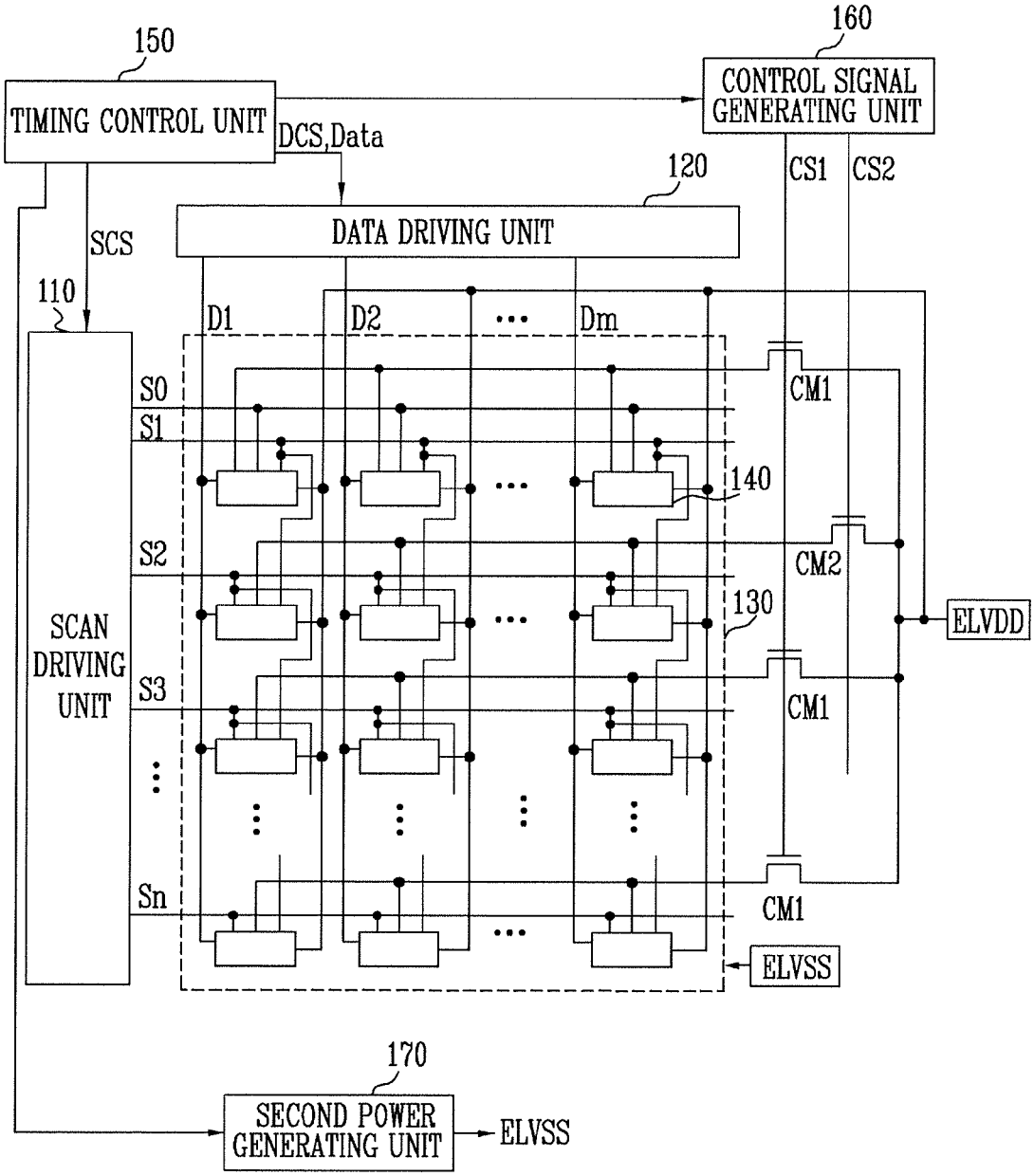
FIG. 2 is a diagram illustrating an organic light emitting display device according to an embodiment of the present invention.

FIG. 2 is a diagram illustrating an organic light emitting display device according to an embodiment of the present invention.

Referring to FIG. 2, the organic light emitting display device includes: pixels 140 coupled to scan lines S0 to Sn and data lines D1 to Dm; a scan driving unit 110 for driving the scan lines S0 to Sn; a data driving unit 120 for driving the data lines D1 to Dm; and a timing control unit 150 for controlling the scan driving unit 110, the data driving unit 120, a control signal generating unit 160, and a second power generating unit 170. Further, the organic light emitting display device includes: a first control transistor CM1 formed in each k-th (where k is either always an odd number or always an even number) horizontal line; a second control transistor CM2 formed in each (k+1)-th horizontal line; the control signal generating unit 160 for controlling the first control transistors CM1 and the second control transistors CM2; and the second power generating unit 170 for generating the second power ELVSS. That is, every other row of pixels is controlled by the first control transistors CM1, and the remaining rows of pixels are controlled by the second control transistors CM2.

The scan driving unit 110 is supplied with a scan driving control signal SCS from the timing control unit 150. The scan driving unit 110 that has been supplied with the scan driving control signal SCS generates a scan signal and sequentially supplies the scan signal to the scan lines S0 to Sn. In this configuration, the scan signal supplied to an i-th (i is a natural number) scan line Si overlaps for a period (for example, a predetermined period) the scan signal supplied to an (i−1)-th scan line Si−1. For example, the scan driving unit 110 can supply the scan signal to these two scan lines to overlap each other during a period of width 1H. In this case, the width of the scan signal is set to a period of width more than 1H, for example, a period of width 2H.

The data driving unit 120 is supplied with a data driving control signal DCS from the timing control unit 150. The data driving unit 120 that is supplied with the data driving control signal DCS supplies data signals to the data lines D1 to Dm when the scan signal is supplied to the scan lines S0 to Sn.

The timing control unit 150 generates the data driving control signal DCS and the scan driving control signal SCS in response to synchronization signals supplied from the outside. The data driving control signal DCS generated by the timing control unit 150 is supplied to the data driving unit 120, and the scan driving control signal SCS is supplied to the scan driving unit 110. Further, the timing control unit 150 supplies data, which is supplied from the outside, to the data driving unit 120.

The first control transistor CM1 is formed between a first power supply ELVDD and the pixels 140 disposed in the k-th horizontal line. The first control transistor CM1 having the above configuration is turned on and off during a scan period in response to a first control signal CS1 and stays turned on during an emission period.

The second control transistor CM2 is formed between the first power supply ELVDD and the pixels 140 disposed in the (k+1)-th horizontal line. The second control transistor CM2 having the above configuration is turned on and off during a scan period in response to a second control signal CS2 and stays turned on during an emission period.

The control signal generating unit 160 supplies the first control signal CS1 to the first control transistors CM1 and the second control signal CS2 to the second control transistors CM2. In this configuration, the control signal generating unit 160 supplies the first and second control signals CS1 and CS2 such that the first control transistors CM1 and the second control transistors CM2 are alternately turned on and off during the scan period. That is, the first control transistors CM1 are on when the second control transistors CM2 are off, the first control transistors CM1 are off when the second control transistors CM2 are on, and this alternation repeats throughout the scan period. Practically, the control signal generating unit 160 supplies the first control signal CS1 and the second control signal CS2 such that the first control transistor CM1 and the second control transistor CM2 are turned both on and off during the period when one scan signal is supplied. Further, the control signal generator 160 supplies the first control signal CS1 and the second control signal CS2 such that the first control transistors CM1 and the second control transistors CM2 stay turned on during the emission period.

The second power generating unit 170 sets a voltage of the second power supply ELVSS to a high-level voltage during the scan period and then sets the voltage of the second power supply ELVSS to a low-level voltage during the emission period. The pixels 140 are configured not to emit light during the scan period when the voltage of the second power supply ELVSS is set to the high-level voltage, and the pixels 140 are configured to emit light during the emission period when the voltage is set to the low-level voltage.

The display unit (or pixel unit) 130 controls the supply of power, which is supplied from the first power supply ELVDD and the second power supply ELVSS from the outside, to the pixels 140. The pixels 140 supplied with the power from the first power supply ELVDD and the second power supply ELVSS produce light corresponding to the data signals. For this embodiment, the pixels 140 each include a plurality of NMOS transistors.

Figure 3:
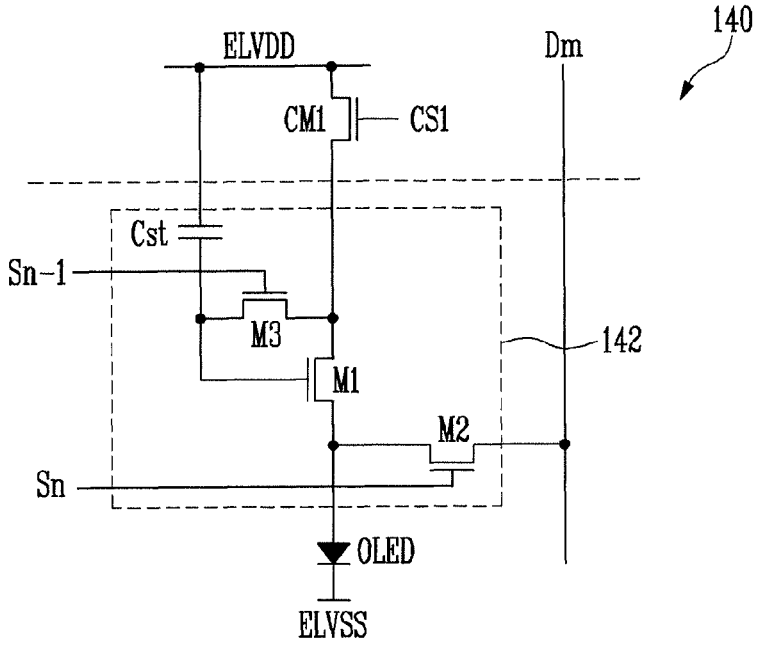
FIG. 3 is a circuit diagram illustrating an embodiment of the pixel shown in FIG. 2.

FIG. 3 is a diagram illustrating an embodiment of the pixel 140 shown in FIG. 2. For convenience of description, the pixel 140 coupled to the n-th scan line Sn and the m-th data line Dm is shown in FIG. 3.

Referring to FIG. 3, the pixel 140 includes: an organic light emitting diode (OLED); and a pixel circuit 142 coupled to the (n−1)-th and n-th scan lines Sn−1 and Sn and the data line Dm, the pixel circuit 142 for controlling the amount of current supplied to the OLED. An anode electrode of the OLED is coupled to the pixel circuit 142, and a cathode electrode of the OLED is coupled to the second power supply ELVSS. The OLED produces light with luminance (for example, a predetermined luminance) in response to a current supplied from the pixel circuit 142.

The pixel circuit 142 is charged to a voltage corresponding to a threshold voltage of a first transistor (i.e., a diving transistor) M1 and a data signal, and controls the amount of current supplied to the OLED based on this voltage. For this embodiment, the pixel circuit 142 includes first to third transistors M1 to M3 and a storage capacitor Cst.

A gate electrode of the first transistor M1 is coupled to a first terminal of the storage capacitor Cst, and a first electrode of the first transistor M1 is coupled to a first control transistor CM1. Further, a second electrode of the first transistor M1 is coupled to the anode electrode of the OLED. The first transistor M1 supplies current corresponding to the voltage of the charged storage capacitor Cst to the OLED.

A first electrode of the second transistor M2 is coupled to the data line Dm, and a second electrode of the second transistor M2 is coupled to the second electrode of the first transistor M1. Further, a gate electrode of the second transistor M2 is coupled to the n-th scan line Sn. The second transistor M2 is turned on and electrically couples the data line Dm to the second electrode of the first transistor M1 when a scan signal is supplied to the n-th scan line Sn.

A first electrode of the third transistor M3 is coupled to the first electrode of the first transistor M1, and a second electrode of the third transistor M3 is coupled to the gate electrode of the first transistor M1. Further, a gate electrode of the third transistor M3 is coupled to the (n−1)-th scan line Sn−1. The third transistor M3 is turned on and diode-connects the first transistor M1 when a scan signal is supplied to the (n−1)-th scan line Sn−1.

The storage capacitor Cst is coupled between the gate electrode of a first transistor M1 and the first power supply ELVDD. In this operation, the storage capacitor Cst is charged to a voltage corresponding to a data signal and the threshold voltage of the first transistor M1.

Figure 4:
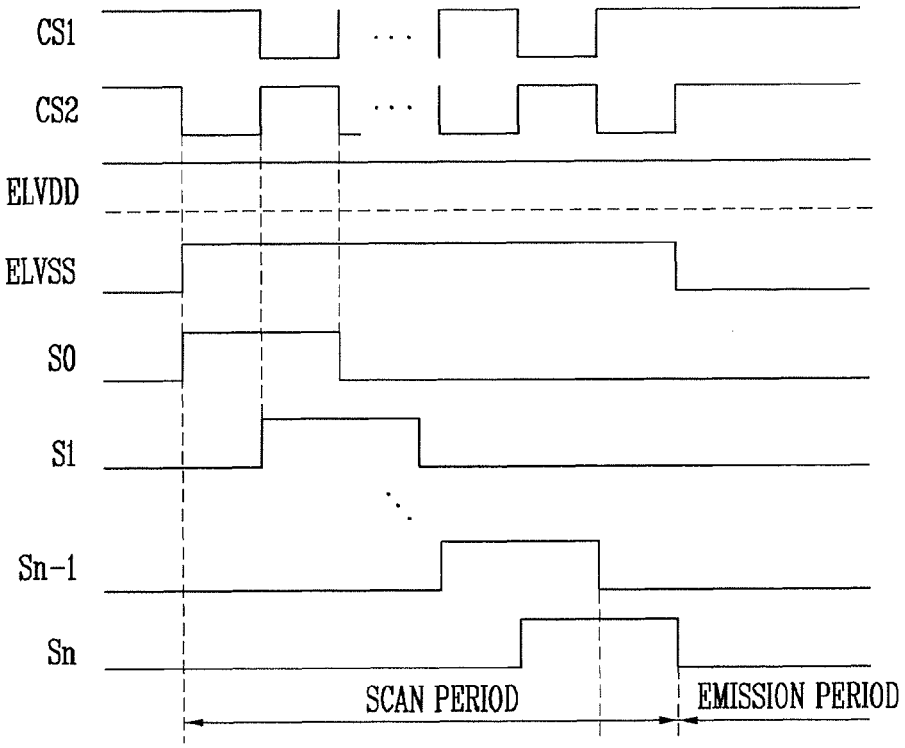
FIG. 4 is a waveform diagram illustrating a method of driving the pixel shown in FIG. 3.

FIG. 4 is a waveform diagram illustrating a method of driving the pixel 140 shown in FIG. 3.

Referring to FIG. 4, one frame period is divided into a scan period and an emission period in the present embodiment. During the scan period, high-level power is supplied from the second power supply ELVSS, and the pixel 140 does not emit light. The pixel 140 is charged to a voltage corresponding to both the data signal and the threshold voltage of the first transistor M1 during the scan period. During the emission period, low-level power is supplied from the second power supply ELVSS. The pixel 140 produces light (for example, predetermined light) in response to the voltage charged during the emission period.

Further, the first control transistor CM1 and the second control transistor CM2 each alternately turn on and off during the period when a scan signal is supplied. In detail, the first or second control transistor CM1 or CM2 coupled with a set or predetermined pixel coupled to the prior scan line (e.g., an (i−1)-th scan line) and the present scan line (e.g., an i-th scan line) is turned on during the period when the scan signal is supplied to the prior scan line but not to the present scan line and turned off during the period when the scan signal is concurrently (for example, simultaneously) supplied to the prior scan line and the present scan line.

Explaining the operation with reference to FIGS. 3 and 4, the scan signal is first supplied to the (n−1)-th scan line Sn−1, and the third transistor M3 is turned on. In this operation, since the first control transistor CM1 is turned on by the first control signal CS1, the gate electrode of the first transistor M1 is initialized to the voltage of the first power supply ELVDD.

Thereafter, the first control transistor CM1 is turned off by the first control signal CS1, and the second transistor M2 is turned on by the scan signal supplied to the n-th scan line Sn. Thus, a data signal from the data line Dm is supplied to the second electrode of the first transistor M1 when the second transistor M2 is turned on. In this operation, the voltage of the gate electrode of the diode-connected first transistor M1 is set to a level obtained by adding the voltage of the data signal to the threshold voltage of the first transistor M1, and the storage capacitor Cst is charged to a voltage corresponding thereto.

The voltage of the second power supply ELVSS is set to a low-level voltage during the emission period and the first and second control transistors CM1 and CM2 are turned on. During the emission period, the pixel 140 supplies current corresponding to the voltage charged during the scan period to the OLED to produce light with a luminance (for example, a predetermined luminance).

Figure 5:
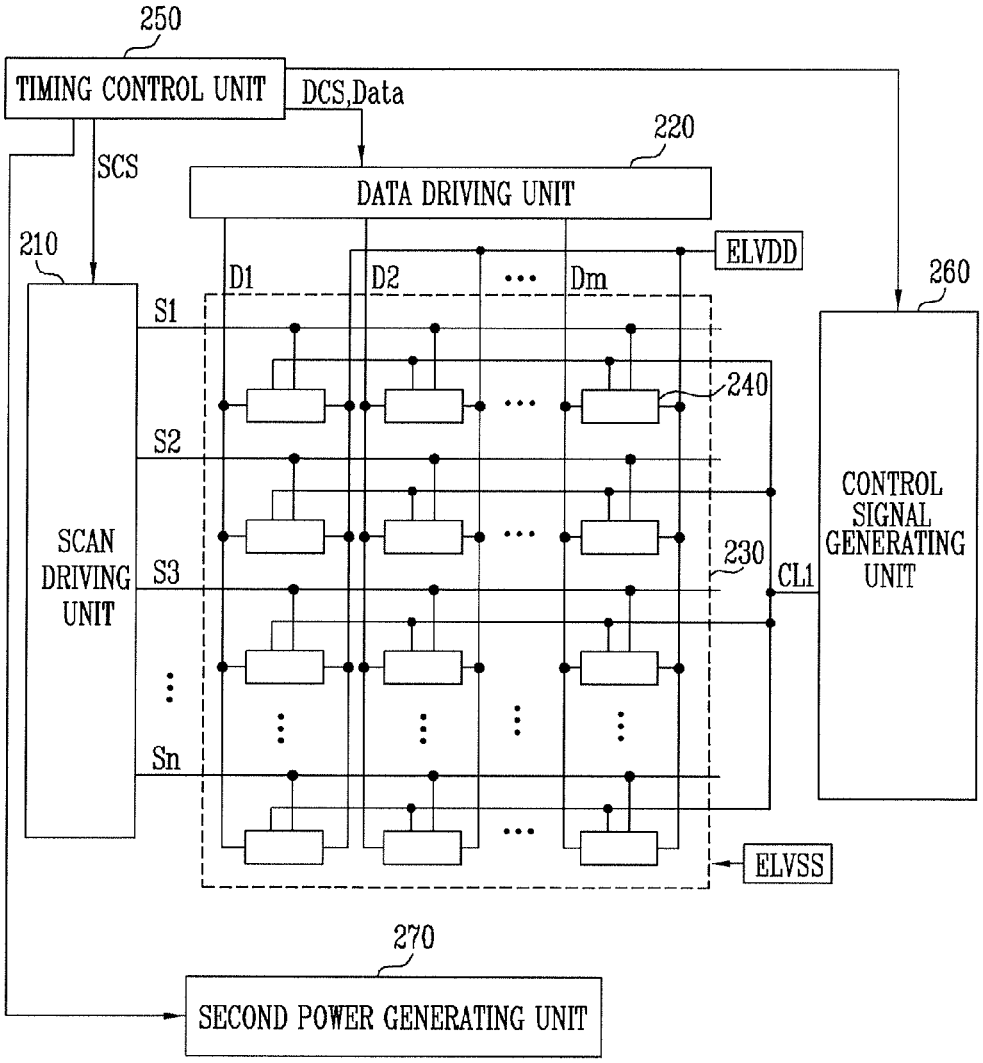
FIG. 5 is a diagram illustrating an organic light emitting display device according to another embodiment of the present invention.

FIG. 5 is a diagram illustrating an organic light emitting display device according to another embodiment of the present invention. In FIG. 5, the first and second control transistors CM1 and CM2 shown in FIG. 2 are formed inside a pixel 240, and the structure is substantially the same.

Referring to FIG. 5, the organic light emitting display device includes: pixels 240 coupled to scan lines S1 to Sn and data lines D1 to Dm; a scan driving unit 210 for driving the scan lines S1 to Sn; a data driving unit 220 for driving the data lines D1 to Dm; a control signal generating unit 260 for generating a control line CL1 (or a first control line); a second power generating unit 270 for generating a second power ELVSS; and a timing control unit 250 for controlling the scan driving unit 210, the data driving unit 220, the control signal generating unit 260, and the second power generating unit 270.

The scan driving unit 210 is supplied with a scan driving control signal SCS from the timing control unit 250. The scan driving unit 210 supplied with the scan driving control signal SCS concurrently (for example, simultaneously) supplies a scan signal to the scan lines S1 to Sn during an initializing period in one frame period. Further, the scan driver 110 sequentially supplies the scan signal to the scan lines S1 to Sn during the scan period in the one frame period.

The data driving unit 220 is supplied with a data driving control signal DCS from the timing control unit 250. The data driving unit 220 that is supplied with the data driving control signal DCS supplies data signals to the data lines D1 to Dm concurrently (for example, in synchronization) with the scan signal to each of the scan lines S1 to Sn during the scan period.

The control signal generating unit 260 supplies a control signal to the control line CL1 during the initializing period and the emission period. In this configuration, the control line CL1 is coupled to fourth transistors included in all of the pixels 240. The timing control unit 250 controls the scan driving unit 210, the data driving unit 220, the control signal generating unit 260, and the second power generating unit 270 in response to synchronization signals supplied from the outside.

The second power generating unit 270 supplies high-level power to the second power supply ELVSS during both the initializing period and the scan period, and supplies low-level power to the second power supply ELVSS during the emission period. In this configuration, the pixels 240 do not emit light during either the initializing period or the scan period, when high-level power of the second power supply ELVSS is supplied.

The display unit (or pixel unit) 230 controls the supply of power, which is supplied from the first power supply ELVDD and the second power supply ELVSS from the outside, to the pixels 240. The pixels 240 supplied with the power from the first power supply ELVDD and the second power supply ELVSS produce light corresponding to the data signals. For this embodiment, the pixels 240 each include a plurality of NMOS transistors.

Figure 6:
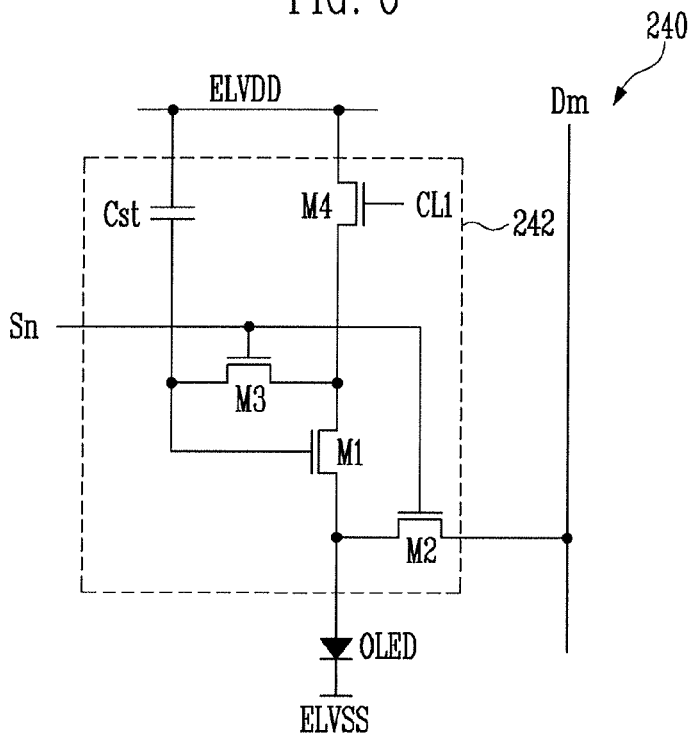
FIG. 6 is a circuit diagram illustrating an embodiment of the pixel shown in FIG. 5.

FIG. 6 is a diagram illustrating an embodiment of the pixel 240 shown in FIG. 5. Referring to FIG. 6, the pixel 240 includes: an OLED; and a pixel circuit 242 coupled to the scan line Sn and the data line Dm, the pixel circuit 242 for controlling the amount of current supplied to the OLED.

An anode electrode of the OLED is coupled to the pixel circuit 242, and a cathode electrode of the OLED is coupled to the second power supply ELVSS. The OLED produces light with a luminance (for example, a predetermined luminance) in response to the current supplied from the pixel circuit 242.

The pixel circuit 242 is charged to a voltage corresponding to a threshold voltage of a first transistor (i.e., a diving transistor) M1 and a data signal, and controls the amount of current supplied to the OLED based on this voltage. For this embodiment, the pixel circuit 242 includes first to fourth transistors M1 to M4 and a storage capacitor Cst.

A gate electrode of the first transistor M1 is coupled to a first terminal of the storage capacitor Cst, and a first electrode of the first transistor M1 is coupled to a second electrode of the fourth transistor M4. Further, a second electrode of the first transistor M1 is coupled to the anode electrode of the OLED. The first transistor M1 supplies current corresponding to the voltage of the charged storage capacitor Cst to the OLED.

A first electrode of the second transistor M2 is coupled to the data line Dm, and a second electrode of the second transistor M2 is coupled to the second electrode of the first transistor M1. Further, a gate electrode of the second transistor M2 is coupled to the n-th scan line Sn. The second transistor M2 is turned on and electrically couples the data line Dm to the second electrode of the first transistor M1 when a scan signal is supplied to the n-th scan line Sn.

A first electrode of the third transistor M3 is coupled to the first electrode of the first transistor M1, and a second electrode of the third transistor M3 is coupled to the gate electrode of the first transistor M1. Further, a gate electrode of the third transistor M3 is coupled to the n-th scan line Sn. The third transistor M3 is turned on and diode-connects the first transistor M1 when the scan signal is supplied to the n-th scan line Sn.

A first electrode of the fourth transistor M4 is coupled to the first power supply ELVDD, and the second electrode of the fourth transistor is coupled to the first electrode of the first transistor M1. Further, a gate electrode of the fourth transistor M4 is coupled to the control line CL1. The fourth transistor M4 is turned on and electrically couples the first power supply ELVDD to the first electrode of the first transistor M1 when a control signal is supplied to the control line CL1.

The storage capacitor Cst is coupled between the gate electrode of the first transistor M1 and the first power supply ELVDD. In this operation, the storage capacitor Cst is charged to a voltage corresponding to a data signal and the threshold voltage of the first transistor M1.

Figure 7:
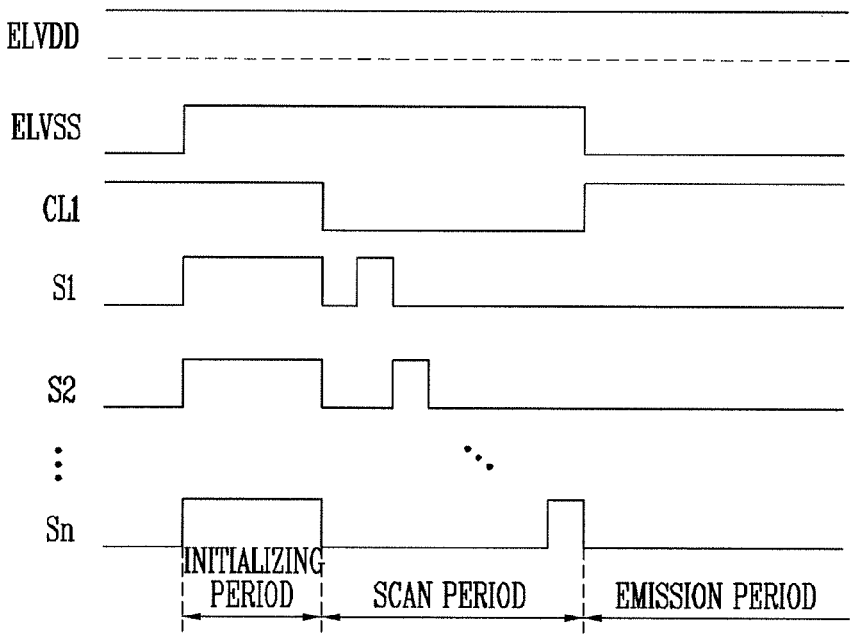
FIG. 7 is a waveform diagram illustrating a method of driving the pixel shown in FIG. 6.

FIG. 7 is a waveform diagram illustrating a method of driving the pixel 240 shown in FIG. 6.

Referring to FIG. 7, one frame period is divided into an initializing period, a scan period, and an emission period in the present embodiment. The voltage of the gate electrode of the first transistor M1 is initialized to the voltage of the first power supply ELVDD during the initializing period. The storage capacitor Cst is charged to a voltage corresponding to a data signal and the threshold voltage of the first transistor M1 during the scan period. Further, the pixel 240 supplies current corresponding to the voltage charged in the scan period to the OLED during the emission period. Accordingly, the OLED produces light with a luminance (for example, a predetermined luminance).

Explaining in detail the operation with reference to FIGS. 6 and 7, a scan signal is supplied first to the scan lines S1 to Sn during the initializing period, and a control signal is supplied to the control line CL1. When the control signal is supplied to the control line CL1, the fourth transistor M4 is turned on. When the scan signal is supplied to the scan lines 51 to Sn, the second transistor M2 and the third transistor M3 are turned on. The voltage of the first power supply ELVDD is supplied to the gate electrode of the first transistor M1 when the third transistor M3 and the fourth transistor M4 are turned on. The data line Dm and the second electrode of the first transistor M1 are electrically coupled when the second transistor M2 is turned on. In this configuration, a voltage (e.g., a predetermined voltage, for example, a voltage the same as that of the first power supply ELVDD) is supplied to the data line Dm.

A scan signal is sequentially supplied to the scan lines S1 to Sn during the scan period. Further, the fourth transistor M4 stays turned off during the scan period. When the scan signal is supplied to the n-th scan line Sn, the second transistor M2 and the third transistor M3 are turned on. The first transistor M1 is diode-connected when the third transistor M3 is turned on. A data signal from the data line Dm is supplied to the second electrode of the first transistor M1 when the second transistor M2 is turned on. In this operation, the voltage of the gate electrode of the first transistor M1 is set to a value obtained by adding the voltage of the data signal to the threshold voltage of the first transistor M1, and the storage capacitor Cst is charged to a voltage corresponding thereto.

A control signal is supplied to the control line CL1, and the voltage of the second power supply ELVSS is set to a low-level voltage during the emission period. When the control signal is supplied to the control line CL1, the fourth transistor M4 is turned on. When the fourth transistor M4 is turned on, the first electrode of the first transistor M1 is electrically coupled with the first power supply ELVDD, such that current corresponding to the voltage of the charged storage capacitor Cst is supplied to the OLED.

Figure 8:
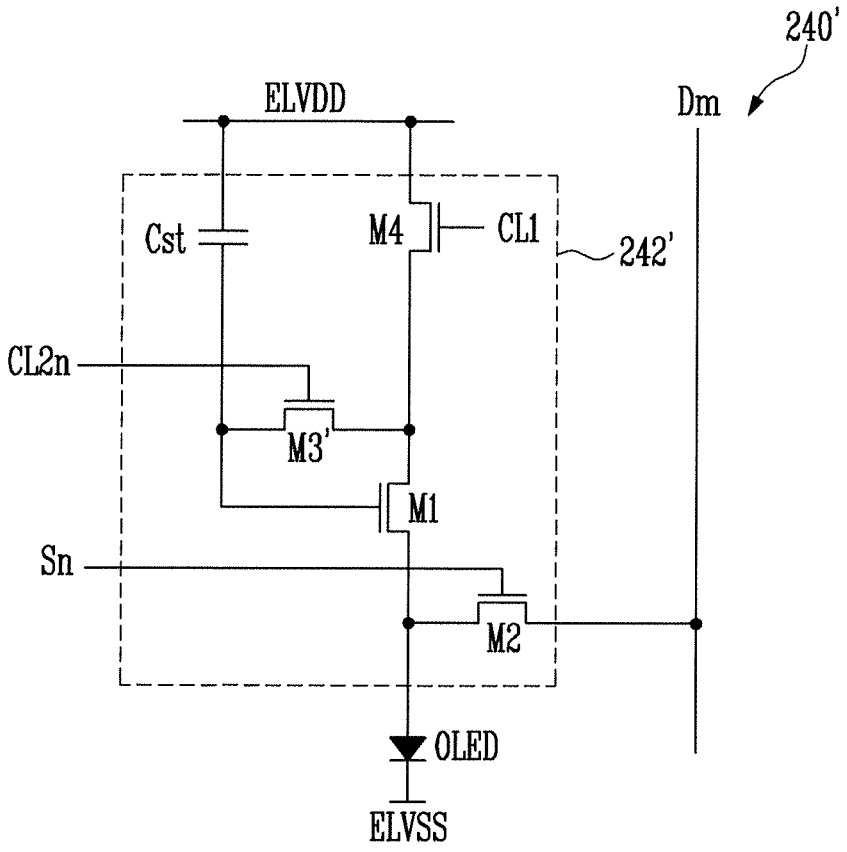
FIG. 8 is a circuit diagram illustrating another embodiment of the pixel shown in FIG. 5.

FIG. 8 is a diagram illustrating another embodiment of the pixel shown in FIG. 5. In explaining FIG. 8, the same components as in FIG. 6 are designated by the same reference numerals and their detailed description is not repeated.

Referring to FIG. 8, the pixel 240' according to another embodiment of the present invention includes: an OLED; and a pixel circuit 242' coupled to the scan line Sn and the data line Dm, the pixel circuit 242' for controlling the amount of current supplied to the OLED. An anode electrode of the OLED is coupled to the pixel circuit 242' and a cathode electrode of the OLED is coupled to a second power supply ELVSS. The OLED produces light with a luminance (for example, a predetermined luminance) in response to the current supplied from the pixel circuit 242'.

The pixel circuit 242' is charged to a voltage corresponding to the threshold voltage of the first transistor M1 and a data signal, and controls the amount of current supplied to the OLED based on this voltage. For this embodiment, the pixel circuit 242' includes first to fourth transistors M1 to M4 and a storage capacitor Cst.

A first electrode of the third transistor M3' is coupled to a first electrode of the first transistor M1, and a second electrode of the third transistor M3' is coupled to a gate electrode of the first transistor M1. Further, a gate electrode of the third transistor M3' is coupled to a second control line CL2*n*. In this configuration, the second control line CLn is formed in each horizontal line, similar to the scan lines S1 to Sn (thus, the second control lines CL21 to CL2*n* correspond to the scan lines S1 to Sn).

The scan driving unit 210 concurrently (for example, simultaneously) supplies a second control signal to the second control lines CL21 to CL2*n* during the initializing period, and sequentially supplies the second control signal to the second control lines CL21 to CL2*n* during the scan period. In this configuration, the second control signals supplied to the second control lines CL21 to CL2*n* during the scan period have a width larger than the scan signal. Further, the second control signal supplied to the i-th second control line CL2*i* is supplied concurrently (for example, simultaneously) with the scan signal supplied to the i-th scan line Si.

Figure 9:
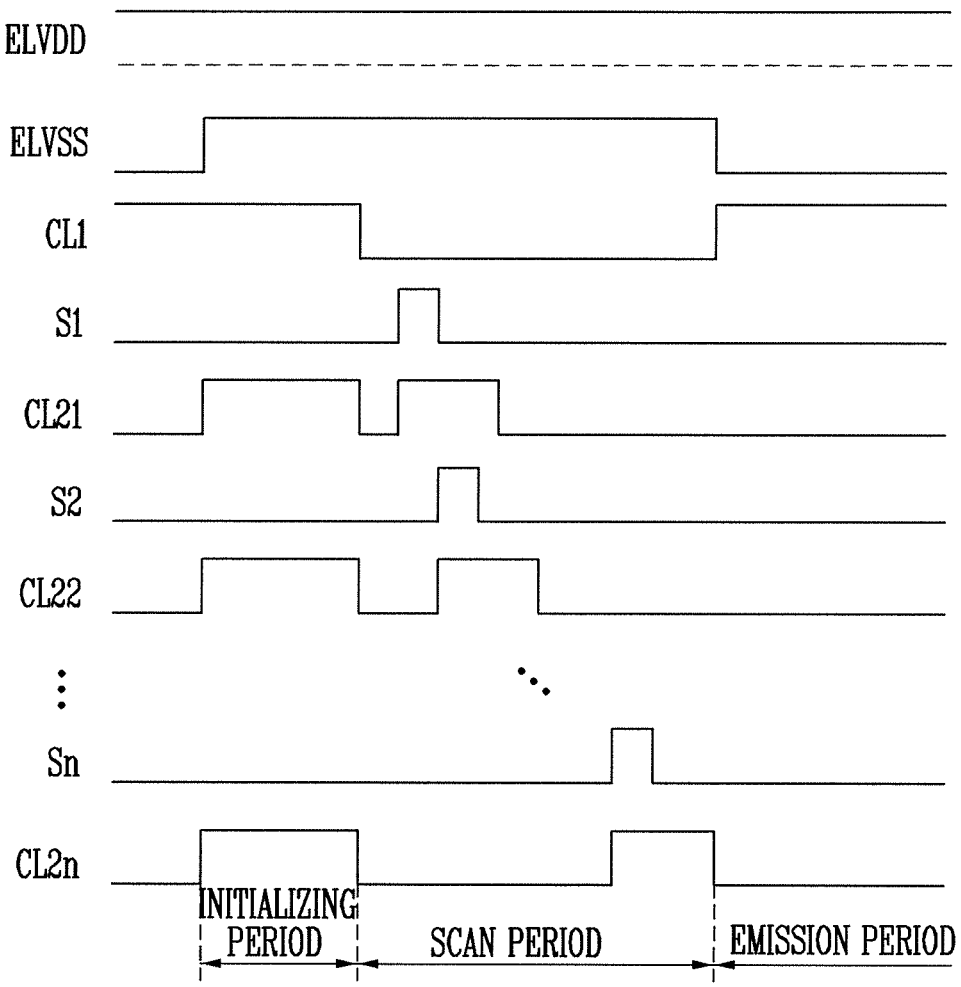
FIG. 9 is a waveform diagram illustrating a method of driving the pixel shown in FIG. 8.

FIG. 9 is a waveform diagram illustrating a method of driving the pixel shown in FIG. 8.

Referring to FIG. 9, a first control signal is first supplied to the first control line CL1 during the initializing period, and a second control signal is supplied to the second control lines CL21 to CL2*n*. When the first control signal is supplied to the first control line CL1, the fourth transistor M4 is turned on. When the second control signal is supplied to the second control lines CL21 to CL2*n*, the third transistor M3' is turned on. The voltage of the first power supply ELVDD is supplied to the gate electrode of the first transistor M1 when the third transistor M3 and the fourth transistor M4 are turned on.

The scan signal is sequentially supplied to the scan lines S1 to Sn during the scan period while second control signals are sequentially supplied to the second control lines CL21 to CL2*n*. Further, the fourth transistor M4 stays turned off during the scan period.

When the scan signal is supplied to the scan line Sn, the second transistor M2 is turned on. A data signal from the data line Dm is supplied to a second electrode of the first transistor M1 when the second transistor M2 is turned on. When the second control signal is supplied to the second control line CL2*n*, the third transistor M3' is turned on. The first transistor M1 is diode-connected when the third transistor M3' is turned on. In this operation, the voltage of the gate electrode of the first transistor M1 is set to a value obtained by adding the voltage of the data signal to the threshold voltage of the first transistor M1, and the storage capacitor Cst is charged to a voltage corresponding thereto.

Meanwhile, the second control signal supplied to the second control line CL2*n* has a width larger than the scan signal supplied from the scan line Sn, such that the third transistor M3' stays turned on during a period (for example, a predetermined period) of time after the second transistor M2 is turned off. In this state, the second electrode of the first transistor M1 keeps the voltage of the data signal, using a parasitic transistor of the OLED. Therefore, the threshold voltage of the first transistor M1 can be additionally compensated during the period when the third transistor M3' stays turned on, such that it is possible to implement an image with more accurate gradation.

A first control signal is supplied to the first control line CL1, and the voltage of the second power supply ELVSS is set to a low-level voltage during the emission period. When the first control signal is supplied to the first control line CL1, the fourth transistor M4 is turned on. When the fourth transistor M4 is turned on, the first electrode of the first transistor M1 is electrically coupled to the first power supply ELVDD, such that current corresponding to the voltage of the charged storage capacitor Cst is supplied to the OLED.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. An organic light emitting display device comprising:

pixels at crossing regions of scan lines and data lines, the scan lines extending along a horizontal direction, the pixels arranged in rows extending along the horizontal direction, the pixels comprising first pixels and second pixels, the first pixels comprising one of pixels in odd-numbered rows or pixels in even-numbered rows, and the second pixels comprising an other of the pixels in the odd-numbered rows or the pixels in the even-numbered rows;

first control transistors between a first power supply and the first pixels, the first power supply for supplying current from the first power supply through the first control transistors to the first pixels; and second control transistors between the first power supply and the second pixels, wherein the first control transistors are configured to turn on and off in alternation with the second control transistors during a scan period of one frame period, and wherein the first and second control transistors are further configured to electrically connect the first and second pixels to the first power supply so that the first power supply supplies current through the first and second control transistors to the first and second pixels to emit light during an emission period of the one frame period.

2. The organic light emitting display device as claimed in claim 1, further comprising:

a scan driving unit for sequentially supplying a scan signal to the scan lines during the scan period;

a data driving unit for supplying data signals to the data lines during the scan period; and a control signal generating unit for supplying first control signals to the first control transistors and second control signals to the second control transistors during the scan period.

3. The organic light emitting display device as claimed in claim 2, wherein the scan driving unit is configured to supply the scan signal to an i-th scan line (i is a natural number) of the scan lines to overlap the scan signal supplied to an (i−1)-th scan line of the scan lines during an overlap period.

4. The organic light emitting display device as claimed in claim 3, wherein:

the scan driving unit is further configured to supply the scan signal during a period of width 2H, and the overlap period has a width 1 H.

5. The organic light emitting display device as claimed in claim 2, wherein the control signal generating unit is further for supplying the first and second control signals such that the first control transistors are configured to turn on and off in alternation with the second control transistors during a period when the scan signal is supplied to one of the scan lines.

6. The organic light emitting display device as claimed in claim 2, wherein the control signal generating unit is further for supplying the first and second control signals such that the first and second control transistors are configured to turn on during the emission period.

7. The organic light emitting display device as claimed in claim 1, wherein each of the pixels in an i-th row (i is a natural number) of the rows comprises:

an organic light emitting diode (OLED) comprising a cathode electrode coupled to a second power supply;

a first transistor comprising a second electrode coupled to the OLED, the first transistor for controlling an amount of current flowing to the OLED;

a second transistor coupled between the second electrode of the first transistor and one of the data lines, the second transistor for turning on when a scan signal is supplied to an i-th scan line of the scan lines;

a third transistor coupled between a first electrode of the first transistor and a gate electrode of the first transistor, the third transistor for turning on when the scan signal is supplied to an (i−1)-th scan line; and a storage capacitor coupled between the gate electrode of the first transistor and the first power supply.

8. The organic light emitting display device as claimed in claim 7, wherein the first electrode of the first transistor is coupled to one of the first control transistors or one of the second control transistors.

9. The organic light emitting display device as claimed in claim 7, wherein the first, second, and third transistors comprise NMOS transistors.

10. The organic light emitting display device as claimed in claim 7, further comprising a second power generating unit for supplying high-level voltage to the second power supply during the scan period, and for supplying low-level voltage to the second power supply during the emission period.

11. An organic light emitting display device comprising:

pixels at crossing regions of scan lines and data lines;

a scan driving unit for sequentially supplying a scan signal to the scan lines during a scan period of one frame period, the one frame period being divided into an initializing period, the scan period, and an emission period that do not overlap one another;

a data driving unit for supplying data signals to the data lines;

a control line driving unit for supplying a first control signal at a first level to a first control line coupled to the pixels during the initializing period and the emission period and at a second level different from the first level during the scan period; and a second power generating unit for supplying high-level voltage to a second power supply such that the pixels do not emit light during the initializing period and the scan period, and for supplying low-level voltage to the second power supply during the emission period.

12. The organic light emitting display device as claimed in claim 11, wherein each of the pixels in an i-th row (i is a natural number) of the pixels comprises:

an organic light emitting diode (OLED) comprising a cathode electrode coupled to the second power supply;

a first transistor comprising a second electrode coupled to the OLED, the first transistor for controlling an amount of current flowing to the OLED;

a second transistor coupled between the second electrode of the first transistor and one of the data lines, the second transistor for turning on when the scan signal is supplied to an i-th scan line of the scan lines;

a third transistor coupled between a first electrode of the first transistor and a gate electrode of the first transistor, the third transistor for turning on when the scan signal is supplied to the i-th scan line;

a fourth transistor coupled between the first electrode of the first transistor and a first power supply, the fourth transistor for turning on when the first control signal is supplied to the first control line; and a storage capacitor coupled between the gate electrode of the first transistor and the first power supply.

13. The organic light emitting display device as claimed in claim 12, wherein the scan driving unit is further for concurrently supplying the scan signal to the scan lines during the initializing period.

14. The organic light emitting display device as claimed in claim 12, wherein the first, second, third, and fourth transistors comprise NMOS transistors.

15. The organic light emitting display device as claimed in claim 11, further comprising second control lines corresponding to the scan lines.

16. The organic light emitting display device as claimed in claim 15, wherein the scan driving unit is configured to concurrently supply a second control signal to the second control lines during the initializing period, and to sequentially supply the second control signal to the second control lines during the scan period.

17. The organic light emitting display device as claimed in claim 16, wherein the second control signal supplied during the scan period has a width larger than that of the scan signal.

18. The organic light emitting display device as claimed in claim 16, wherein the scan driving unit is further configured to supply the scan signal to an i-th scan line (i is a natural number) of the scan lines concurrently with supplying the second control signal to an i-th second control line of the second control lines.

19. The organic light emitting display device as claimed in claim 16, wherein each of the pixels in an i-th row (i is a natural number) of the pixels comprises:

an organic light emitting diode (OLED) comprising a cathode electrode coupled to the second power supply;

a first transistor comprising a second electrode coupled to the OLED, the first transistor for controlling an amount of current flowing to the OLED;

a second transistor coupled between the second electrode of the first transistor and one of the data lines, the second transistor for turning on when the scan signal is supplied to an i-th scan line of the scan lines;

a third transistor coupled between a first electrode of the first transistor and a gate electrode of the first transistor, the third transistor for turning on when the second control signal is supplied to an i-th second control line of the second control lines;

a fourth transistor coupled between the first electrode of the first transistor and a first power supply, the fourth transistor for turning on when the first control signal is supplied to the first control line; and a storage capacitor coupled between the gate electrode of the first transistor and the first power supply.

20. The organic light emitting display device as claimed in claim 19, wherein the first, second, third, and fourth transistors comprise NMOS transistors.

* * * * *